United States Patent [19]

McDonald et al.

[11] 4,382,317

[45] May 10, 1983

[54] PIN STEM CLUTCH

[75] Inventors: Thomas J. McDonald, Attleboro; Robert E. Chatel, Wellesley, both of Mass.

[73] Assignee: Leach & Garner Company, Attleboro, Mass.

[21] Appl. No.: 300,808

[22] Filed: Sep. 10, 1981

[51] Int. Cl.[3] ..... A44C 7/00

[52] U.S. Cl. ..... 24/155 BB; 63/12

[58] Field of Search ..... 63/12, 13; 24/155 BB, 24/108, 217 R

[56] References Cited

U.S. PATENT DOCUMENTS

| | | | |
|---|---|---|---|
| 730,136 | 6/1903 | Lentz . | |
| 866,425 | 9/1907 | Bloch . | |
| 999,171 | 7/1911 | Leu | 24/155 BB |
| 1,016,943 | 2/1912 | Hoops | 24/155 BB |
| 4,106,310 | 8/1978 | Abramowitz | 63/12 |

FOREIGN PATENT DOCUMENTS

| | | | |
|---|---|---|---|
| 460731 | 10/1913 | France | 24/155 BB |
| 1117966 | 6/1968 | United Kingdom | 63/12 |

*Primary Examiner*—F. Barry Shay

*Attorney, Agent, or Firm*—Barlow & Barlow, Ltd.

[57] ABSTRACT

A pin stem clutch or securing device is disclosed which is particularly adapted to grip and hold a shank, for example a pin, the pin being utilized in an earring device, a hat ornament device or the like.

2 Claims, 8 Drawing Figures

PIN STEM CLUTCH

BACKGROUND OF THE INVENTION

Securing devices particularly directed to pierced earring structures have taken a variety of forms. Perhaps the most well known form is an ear nut which has arcuately inturned ends that grip a post as seen for example in French Pat. No. 102,232. With this type of ear nut or clutch, the clamping action that is exerted on the post is a function solely of the degree of springness of the stock and the ability of the stock to resist the permanent deformation. The design therefore dictates the use of metallic stock having a certain minimum thickness and the requisite temper in order to perform properly.

In certain applications it is desirable to have less material content to the clutch, particularly if the clutch is made out of precious metal and/or alloys or overlays containing a precious metal.

SUMMARY OF THE INVENTION

It is an object of the present invention to provide a pin stem clutch that will provide a stronger gripping force than similar clutches of the prior art, while maintaining the same cross section of material and similar configuration.

Broadly, the invention is defined as a pin stem clutch that may be detachably secured to a post that has a base body member that has a central pin receiving aperture therein. The ends of the base are turned upwardly and into an arc to terminate adjacent the base at opposite sides of the aperture therein, where the terminal ends are secured to the base such as by welding, soldering, staking, gluing, or any other means known to those skilled in the art.

DESCRIPTION OF THE PREFERRED EMBODIMENT

Figure 1:
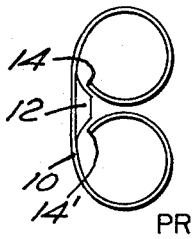
PRIOR ART FIG. 1
FIG. 1 is an elevational view of the arrangement existing in the prior art.
Figure 1A:
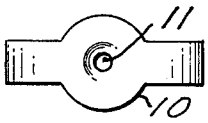
PRIOR ART FIG. 1A
FIG. 1A is an enlarged bottom view thereof.
Figure 3:
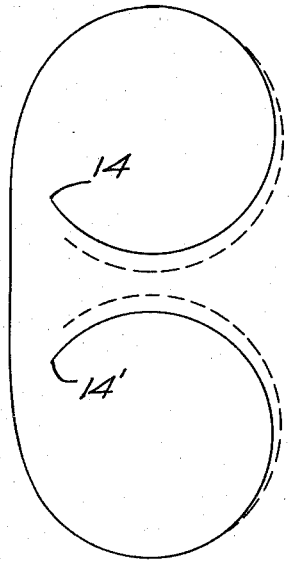
PRIOR ART FIG. 3
FIG. 3 is a diagrammatic view showing the action of the prior art.
Figure 2:
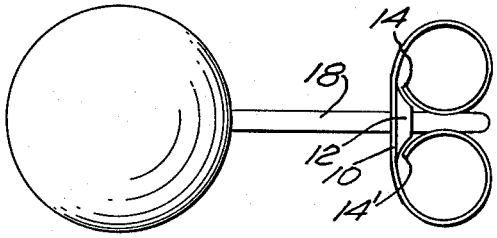
PRIOR ART FIG. 2
FIG. 2 is a view of the prior art arrangement on a pin stem.
Figure 4:
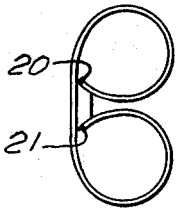
FIG. 4 is an elevational view of the clutch of the invention.
Figure 1B:
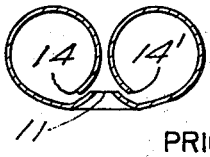
PRIOR ART FIG. 1B
FIG. 1B is a central sectional view thereof.
Figure 6:
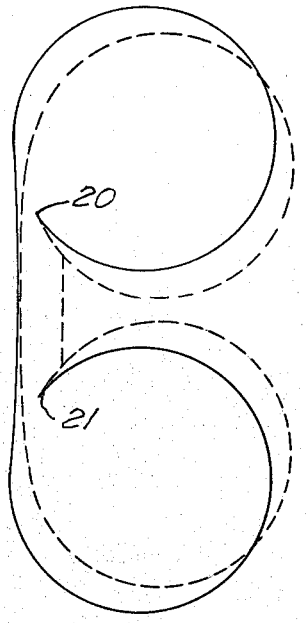
FIG. 6 is a diagrammatic view showing the action of the invention.
Figure 5:
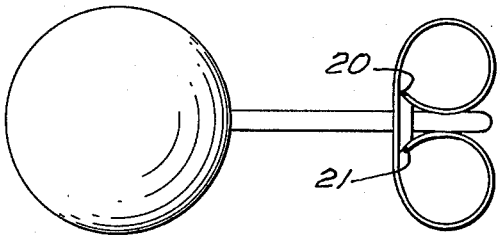
FIG. 5 is an elevational view of the clutch of the invention installed on a pin stem.

The clutch of the prior art is illustrated in FIGS. 1 and 2 and consists essentially of a base portion 10 that has a central circular recess 11 that on the opposite side thereof, creates a frusto-conical portion 12 with an aperture therein to receive a pin. This structure provides a slight recess therein and allows easy guided entry of the pin from the left as seen in the drawing. The integral ends of the base or body portion are bent into an arcuate form to form two spaced arcs with terminal ends 14, 14' of each portion lying free. As seen in FIG. 2, when the clutch is placed onto a pin stem 18, the ends will move downwardly slightly toward the base as a result of the movement of the arcuate portion by the pin. This action is more clearly brought out in FIG. 3 where the relaxed position of the clutch is seen in dotted line and the clamping position is seen in solid line. It is customary in making earring nuts or clutches of this description to utilize material that is 0.005 to 0.010 inch thick (0.13 to 0.25 mm). With this thickness of material, there is a certain intrinsic resilience and it can be readily appreciated that if the material is gold, it would be desirable to reduce the monetary amount of the gold in the item and use a thinner stock. In order to have the same resilience with thinner stock, the arrangement of FIG. 4 and 5 has been developed in which the terminal ends of the base which form the arcuate loops have been secured to the base as at 20, 21 with the ends secured as by welding, soldering, gluing, staking or any other means known to those skilled in the art. The presence of the frusto-conical portion 12 provides an enlarged anchor point for the ends 20, 21. The arcuate portion of the spring portion is required to deform to an oblong shape as seen in FIG. 6. The resistance to deformation of the rigid circular spring transfers much of the separating forces caused by the post insertion to the base body member, as seen in FIG. 6 of the drawings where the relaxed position is in broken line and the clamped position is in solid line.

It follows, therefore, that if the clutches of the prior art and of the instant invention maintain the same thickness of stock, that the form of the invention will provide a stronger gripping force. This is due to the increased role of the base body member in contributing to resistance to deformation and the increased resilience of the arcuate loops caused by fixing their ends to the base member.

The clutch therefore allows one to obtain an adequate gripping force with less material, and when gold or gold overlay is used as the stock material, then cost becomes an important factor. The clutch, however, has numerous applications in all forms of fasteners.

We claim:

1. A pin stem clutch for detachable securement to a post comprising a base body member having a central pin receiving aperture and having upwardly turned integral ends, said ends bent in respective arcs toward each other, the terminal portion of each arc secured to the body member at the end of the arc on its side of the aperture so that a smoothly curved loop is formed at each side of the aperture, whereby for each loop the entire arc on opposite sides of diametrically opposite portions enters into the resilient action of gripping of a pin by reason of the transfer of the pin pressure across the arc and the flexing of opposite sides of the arc.

2. A pin stem clutch as in claim 1, wherein the base body member has a frusto-conical raised portion about the aperture, said ends secured to said raised portion.

* * * * *